US008695114B2

(12) United States Patent
Weisman

(10) Patent No.: US 8,695,114 B2
(45) Date of Patent: Apr. 15, 2014

(54) ADJUSTABLE BATHING SUIT

(71) Applicant: Jennifer Weisman, Short Hills, NJ (US)

(72) Inventor: Jennifer Weisman, Short Hills, NJ (US)

( * ) Notice: Subject to any disclaimer, the term of this patent is extended or adjusted under 35 U.S.C. 154(b) by 0 days.

(21) Appl. No.: 13/872,989

(22) Filed: Apr. 29, 2013

(65) Prior Publication Data

US 2013/0232656 A1 Sep. 12, 2013

Related U.S. Application Data

(63) Continuation of application No. 13/078,395, filed on Apr. 1, 2011, now Pat. No. 8,429,762.

(51) Int. Cl.
*A41D 7/00* (2006.01)
*A41F 9/00* (2006.01)

(52) U.S. Cl.
CPC .. *A41D 7/005* (2013.01); *A41F 9/00* (2013.01)
USPC ..... 2/67; 2/237; 2/238

(58) Field of Classification Search
CPC ..... A41F 9/02; A41F 9/00; A41F 9/025; A41F 1/004; A41D 1/06; A41D 7/005; A41D 2300/32; A41B 9/14
USPC ..... 2/237, 238, 228, 67, 221, 227, 235, 2/236, 219, 220, 76, 78.3, 75, 80, 318, 2/321, 326, 338, 78.2, 78.4, 79, 401, 402, 2/404, 408, 919, 52
See application file for complete search history.

(56) References Cited

U.S. PATENT DOCUMENTS 146,830 A * 1/1874 Linthicum ..... 2/237
210,713 A * 12/1878 Schollian ..... 2/237
220,885 A * 10/1879 Spies ..... 2/237
261,664 A * 7/1882 Brown ..... 2/309
318,230 A * 5/1885 Bernstein ..... 2/237
362,565 A * 5/1887 Yarwood ..... 2/400
441,637 A * 12/1890 Bloch ..... 2/237
570,317 A * 10/1896 Lewis ..... 2/237
1,016,538 A * 2/1912 Ashworth ..... 2/400
1,018,009 A * 2/1912 Schremp ..... 2/400
1,030,779 A * 6/1912 Hershkowitz ..... 2/237
1,071,353 A * 8/1913 Schneider ..... 2/400
1,105,282 A * 7/1914 Leibel ..... 2/309
1,174,976 A * 3/1916 Gaines ..... 2/221

(Continued)

FOREIGN PATENT DOCUMENTS

WO WO 91/04681 * 4/1991

*Primary Examiner* — Amy Vanatta

(74) *Attorney, Agent, or Firm* — Porzio, Bromberg & Newman, P.C.

(57) ABSTRACT

An adjustable bathing suit including a channel extending through the length of a waistband. An adjustable band is received within at least a portion of the channel and is attached to the bathing suit. Preferably, the adjustable band extends around the front of the hips around a majority of the waistband. The adjustable band includes a plurality of openings for receiving a button attached to the bathing suit. The button can be located at the rear of the bathing suit. An opening in the waistband is provided in the location of the button to provide access to the adjustable band contained within the channel. A flap attached to an upper portion of the waistband extends over the opening of the waistband for closing the opening. The flap can include a self-gripping material and a self-gripping material can be positioned under the flap for providing secure closure of the flap.

10 Claims, 3 Drawing Sheets

(56) References Cited

U.S. PATENT DOCUMENTS

| | | | | | |
|---|---|---|---|---|---|
| 1,185,914 | A | * | 6/1916 | Klein | 2/237 |
| 1,724,480 | A | * | 8/1929 | Hentzler | 2/237 |
| 1,825,271 | A | * | 9/1931 | Karberg | 2/237 |
| 1,951,450 | A | * | 3/1934 | Sochel | 2/237 |
| 1,969,333 | A | * | 8/1934 | Steuer | 2/67 |
| 2,200,090 | A | * | 5/1940 | Konski | 2/237 |
| 2,252,519 | A | * | 8/1941 | Ottusch | 2/237 |
| 2,335,971 | A | * | 12/1943 | Scholle | 2/221 |
| 2,418,772 | A | * | 4/1947 | Jackson | 2/235 |
| 2,824,560 | A | * | 2/1958 | Clinton | 602/67 |
| 3,207,155 | A | * | 9/1965 | Casey | 602/67 |
| 3,307,203 | A | * | 3/1967 | Parsont et al. | 2/231 |
| 3,445,862 | A | * | 5/1969 | Parsont et al. | 2/237 |
| 4,389,733 | A | * | 6/1983 | Boykins, Jr. | 2/466 |
| 4,604,761 | A | * | 8/1986 | Wright | 2/227 |
| 4,803,740 | A | * | 2/1989 | Dawson | 2/215 |
| 4,987,610 | A | * | 1/1991 | Hunt | 2/46 |
| 7,174,574 | B2 | * | 2/2007 | Fontes | 2/235 |
| D677,858 | S | * | 3/2013 | Valles | D2/738 |
| 8,474,065 | B2 | * | 7/2013 | Kingsbury et al. | 2/221 |
| 2008/0086794 | A1 | * | 4/2008 | Gardner, III | 2/237 |
| 2009/0007314 | A1 | * | 1/2009 | Beven | 2/228 |
| 2010/0229284 | A1 | * | 9/2010 | Wilson, II | 2/237 |
| 2013/0031698 | A1 | * | 2/2013 | Valles | 2/221 |

* cited by examiner

ADJUSTABLE BATHING SUIT

BACKGROUND OF THE INVENTION

1. Field of the Invention

The present invention relates to a bathing suit for covering the lower part of a user's body and in particular to a bathing trunk or board shorts having an adjustable waist.

2. Description of Related Art

Conventional bathing trunks include an elastic waistband. A string threaded through a channel of the waistband can be used for further adjusting the size of the waistband. The string has the drawback of loosening during use and not providing precise adjustment of the waistband. Conventional bathing trunks typically do not include a fly.

U.S. Pat. No. 7,174,574 describes a board short for surfing, swimming or other similar activities including a waistband, left front panel and overlapping right front panel along the center front to provide the appearance of a zippered fly. Laces extending through grommets at the waistband close the fly. VELCRO® fasteners are used to close the fly at the waistband area.

U.S. Patent Application Publication No. 2009/007314 describes board shorts including a waistband having a tab extending from a free end being placed to cover an end of the waistband. The tab has a self-gripping strip placed facing a complementary self-gripping strip of the waistband. A lace extends between a hole in the tab and hole in waistband so as to be able to be tied to on the inside of the waistband. The above-described patents do not describe precise adjustment of the waistband to accommodate for different sized waists while not producing bunching up of the fabric of the bathing suit.

It is desirable to provide a bathing suit, and in particular board shorts, in which the waistband can be expeditiously adjusted for providing a precise fit of the garment without the fabric bunching up.

SUMMARY OF THE INVENTION

The correct fit of a bathing suit is desirable for all wearers. However, the correct fit of a waistband of swim suit trunks is often difficult to obtain especially when the dimensions or waist of a wearer is between conventional waistband sizes. This often occurs in youth sizes in which a waist of a youth may be in-between conventional waistband sizes, for example, a 24 inch and 25 inch waist. The youth may have the leg length appropriate for the larger waistband size, but a waist which is too small to be accommodated by the larger sized waistband. If the smaller waist size is selected, the leg length will be too short on the youth. If the larger sized waistband is selected, the bathing suit will fall too low below the waist and may not conceal the proper body areas. In a conventional bathing suit, when a string is used to reduce the waist size, it can be pulled too tight and is uncomfortable for the wearer.

The present invention provides a solution by providing an adjustable waistband for a bathing suit, in particular to swim trunks or board shorts, which can be expeditiously adjusted to a precise fit.

The bathing suit includes a channel extending through the length of a waistband. The waistband extends on either side of a fly opening in the front. An adjustable band is received within at least a portion of the channel and is attached to the bathing suit. Preferably, the adjustable band extends around the front of the hips around a majority of the waistband, for example, ¾ around the waistband. The adjustable band includes a plurality of openings for receiving a button attached to the bathing suit. For example, the adjustable band can be formed of elastic. The openings in the adjustable band are placed at precise distances from one another for providing precise increments of lengths of the adjustable band and in turn a precise length of the waistband is adjusted to match the actual waist of the wearer.

The button is attached to an outside surface of the bathing suit. Preferably, the button is placed at a center rear portion of the waistband. An opening in the waistband is provided in the location of the button to provide access to the adjustable band contained within the channel. A flap attached to an upper portion of the waistband extends over the opening of the waistband for closing the opening. The flap can include a self-gripping material and a self-gripping material can be positioned under the flap for providing secure closure of the flap.

In one embodiment, the adjustable bathing suit includes a front fly. In this embodiment, the adjustable bathing suit is board shorts. During use, the bathing suit can be tried on by the wearer and the fly closed. The flap is opened from the rear of the bathing suit to expose the adjustable band. For example, the flap can be opened by a person accessing the rear of the bathing suit, such as a mother adjusting the adjustable bathing suit for her son. The adjustable band is adjusted to the waist of the wearer and one of the openings of the adjustable band aligned with the button is received over the button to thereby attach the adjustable band to the button. In one embodiment, the adjustable band includes a pair of adjustable bands attached to either side of the bathing suit and extending toward the button. An opening in each of the pair of adjustable bands is attached to the button. The flap is closed over the adjustable band. The adjustable band and flap lie flat against the waistband to provide a streamline and secure fit of the bathing suit.

The invention will be more fully described by reference to the following drawings.

DETAILED DESCRIPTION

Figure 1:
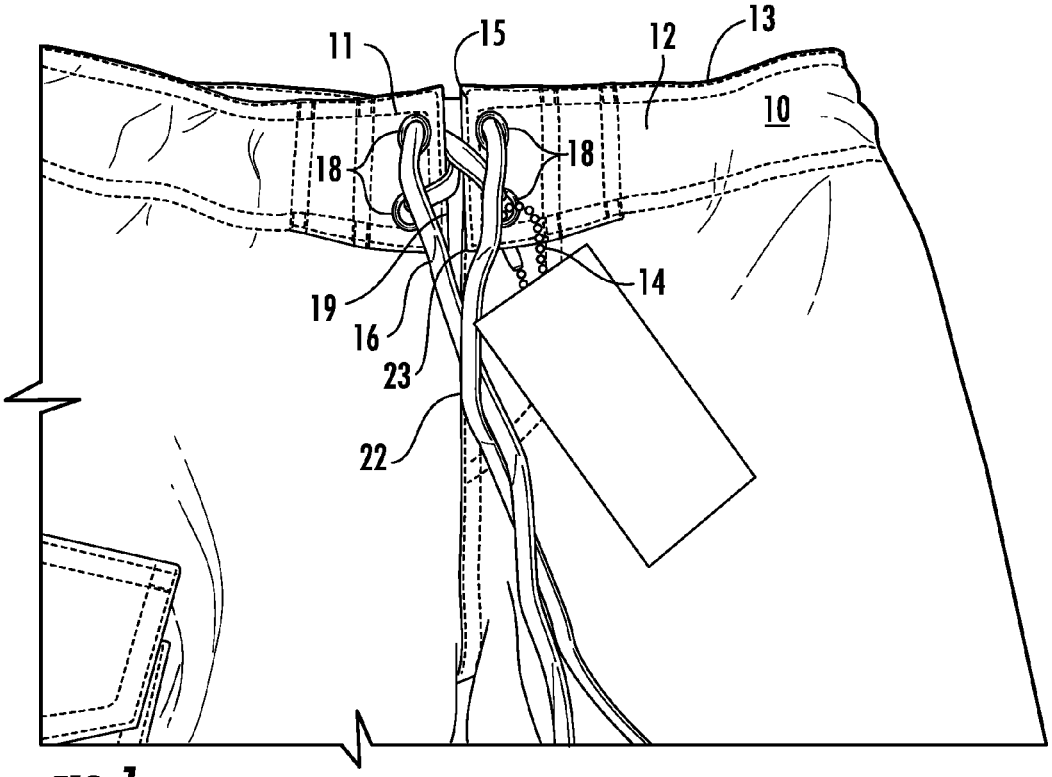
FIG. 1 is a schematic diagram of a partial front view of the adjustable bathing suit in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic view of adjustable bathing suit 10 in accordance with the teachings of the present invention. Adjustable bathing suit 10 includes waistband 12 at top portion 13. Waistband 12 can include channel 11 extending between waistband 12 and adjustable bathing suit 10. Fly 14 can be formed at front center portion 15. Laces 16 extending through grommets 18 positioned in waistband 12 can be used to close waistband 12. Self-gripping material 19 can be attached at front center portion 15 below fly flap 22 and to underside 23 of fly flap 22 for closing of fly 14. In an alternate embodiment, other closures method can be used to close fly 14 and/or waistband 12.

Adjustable bathing suit 10 is formed of a quick-dry type fabric. A suitable material for adjustable bathing suit 10 is polyester.

Figure 2:
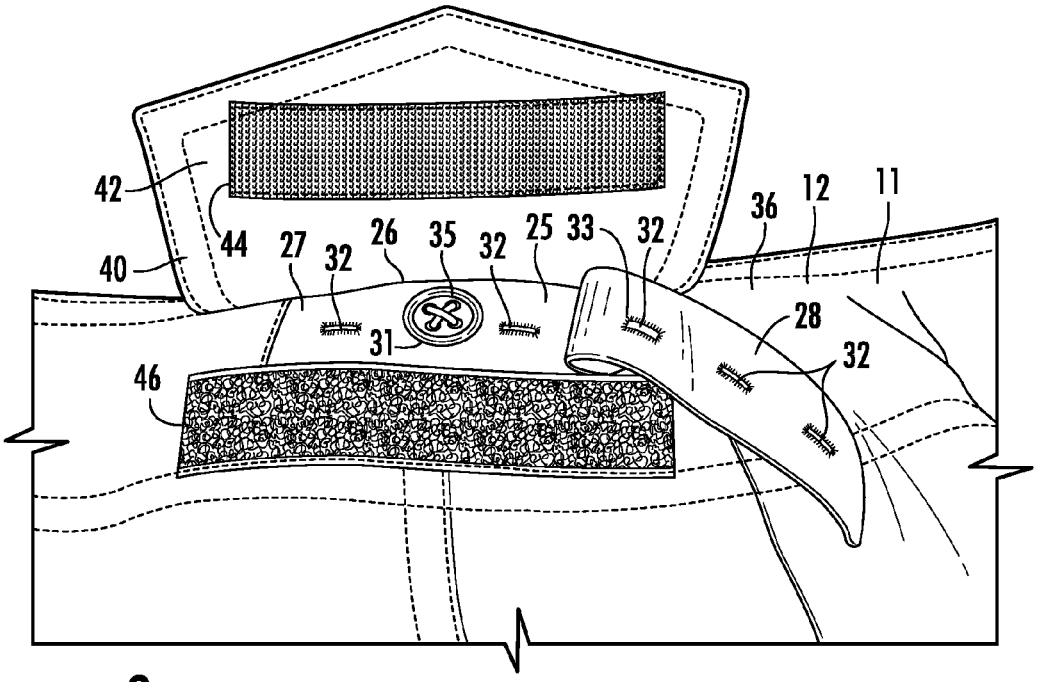
FIG. 2 is a schematic diagram of a partial rear view of the adjustable bathing suit including the adjustable waistband and a flap in an open position after insertion of a button into one of the openings of one adjustable band.

Adjustable band 25 is positioned at rear center portion 26 of waistband 12, as shown in FIG. 2. Adjustable band 25 can be formed of first adjustable band 27 attached at a distance to the left of rear center portion 26 and second adjustable band 28 attached at a distance to the right of rear center portion 26. For example, first adjustable band 27 and second adjustable band 28 can extend within channel 11 at a predetermined distance. Adjustable band 27 and adjustable band 28 can be independently adjusted.

Figure 6:
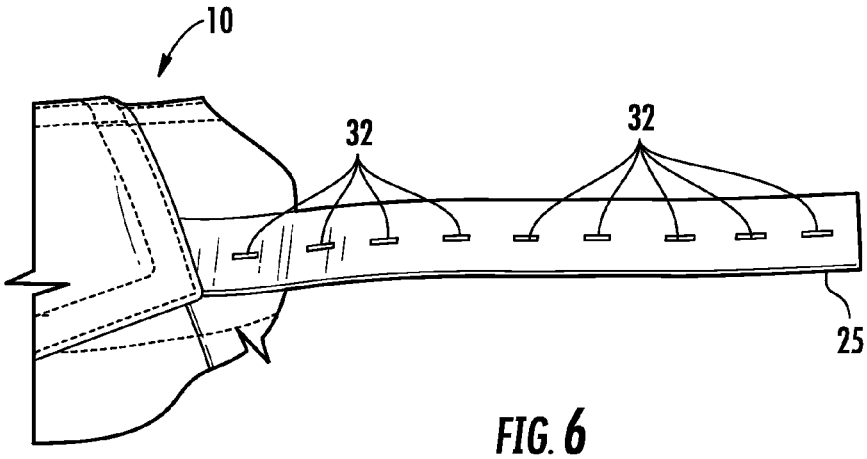
FIG. 6 is a schematic diagram of the adjustable band in an extended position.

A plurality of openings 32 in the shape of button holes are formed in adjustable band 27 and adjustable band 28. Stitching 33 can be formed around openings 32 for strengthening openings 32 and preventing fraying of material of adjustable band 25. For example, adjustable bands 25, 27 and 28 can be formed of elastic. Openings 32 are placed at precise distances from one another for providing precise increments of the length of adjustable bands 25, 27 and 28. In one embodiment, four openings 32 are placed at ¼ inch increments for providing adjustment up to about one inch. Alternatively, openings 32 can be positioned at ⅜ inch from edge to edge of adjacent openings 32, as shown in FIG. 6. In one embodiment, example lengths of waistband 12 are for youth sizing in the range of about 21 inches to 27 inches, and openings 32 provide adjustment up to about one inch on either side of the adjustable bathing suit 10. It will be appreciated that other lengths of waistbands 12 distances between openings 32 can be used in accordance with the teachings of the present invention.

Referring to FIG. 2, button 35 is attached at center 31 of rear center portion 26 of outside surface 36 of waistband 12. Opening 32 of first adjustable band 27 is received over button 35. For example, button 35 can be sewn to waistband 12. Button 35 can have various shapes.

Figure 3:
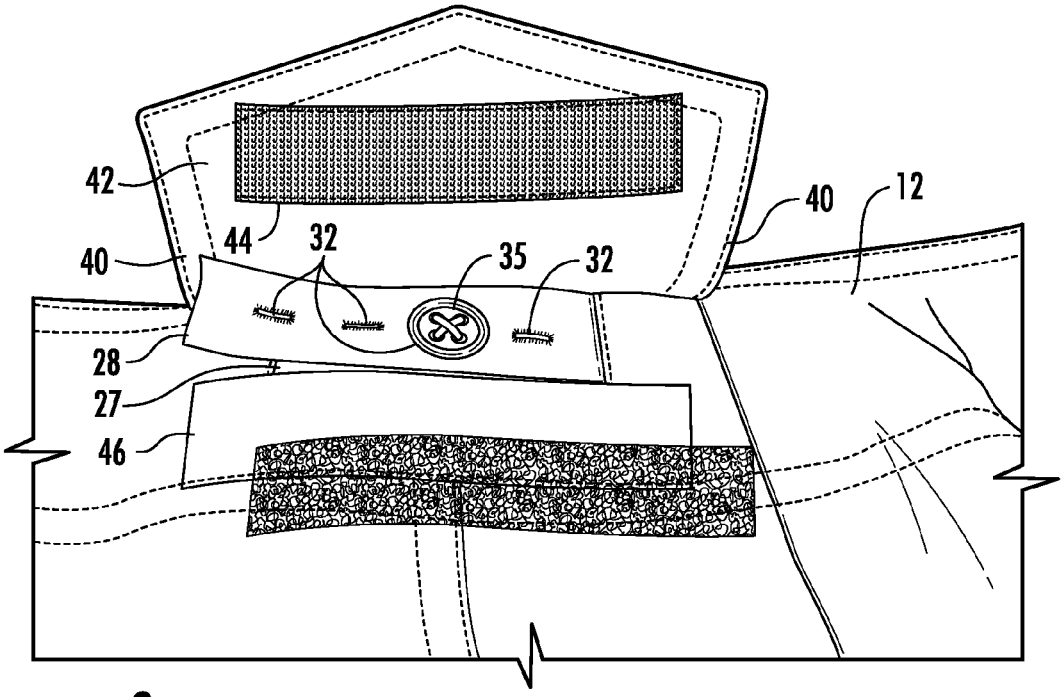
FIG. 3 is a schematic diagram of the adjustable waistband shown in FIG. 2 after insertion of a button into one of the openings of one adjustable band.

Opening 32 of second adjustable band 28 is received over button 35, as shown in FIG. 3. It will be appreciated that either first adjustable band 27 or second adjustable band 28 can be attached first to button 35 and thereafter the other of the adjustable bands is attached. Openings 32 of first adjustable band 27 and second adjustable band 28 are selected to provide a proper length of adjustable band 27 and adjustable band 28 and to allow adjustable bathing suit 10 to have a desired correct fit of waistband 12 in order to prevent bathing suit 10 from sliding too far down the hips of a wearer.

Figure 4:
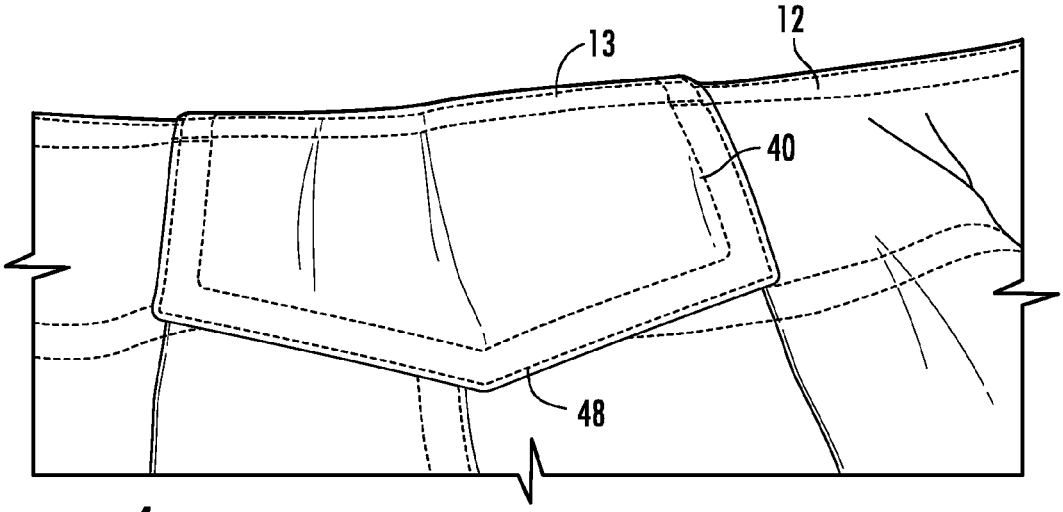
FIG. 4 is a schematic diagram of a partial rear view of the adjustable bathing suit including the flap in a closed position.

Flap 40 attached to top portion 13 of the waistband 41 extends over adjustable band 25 for concealing adjustable band 25, as shown in FIGS. 2 and 4. Self-gripping material strip 44 can be attached to underneath surface 42 of flap 40, as shown in FIG. 3. Self-gripping material strip 46 can be attached to waistband 12 at a position under flap 40 adjacent to adjustable band 25. Self-gripping material strip 44, 46 can be formed of a hook and loop material such as VELCRO®. In an alternate embodiment, other closures method can be used to close flap 40. Edge 48 of flap 40 can be angled.

Figure 5:
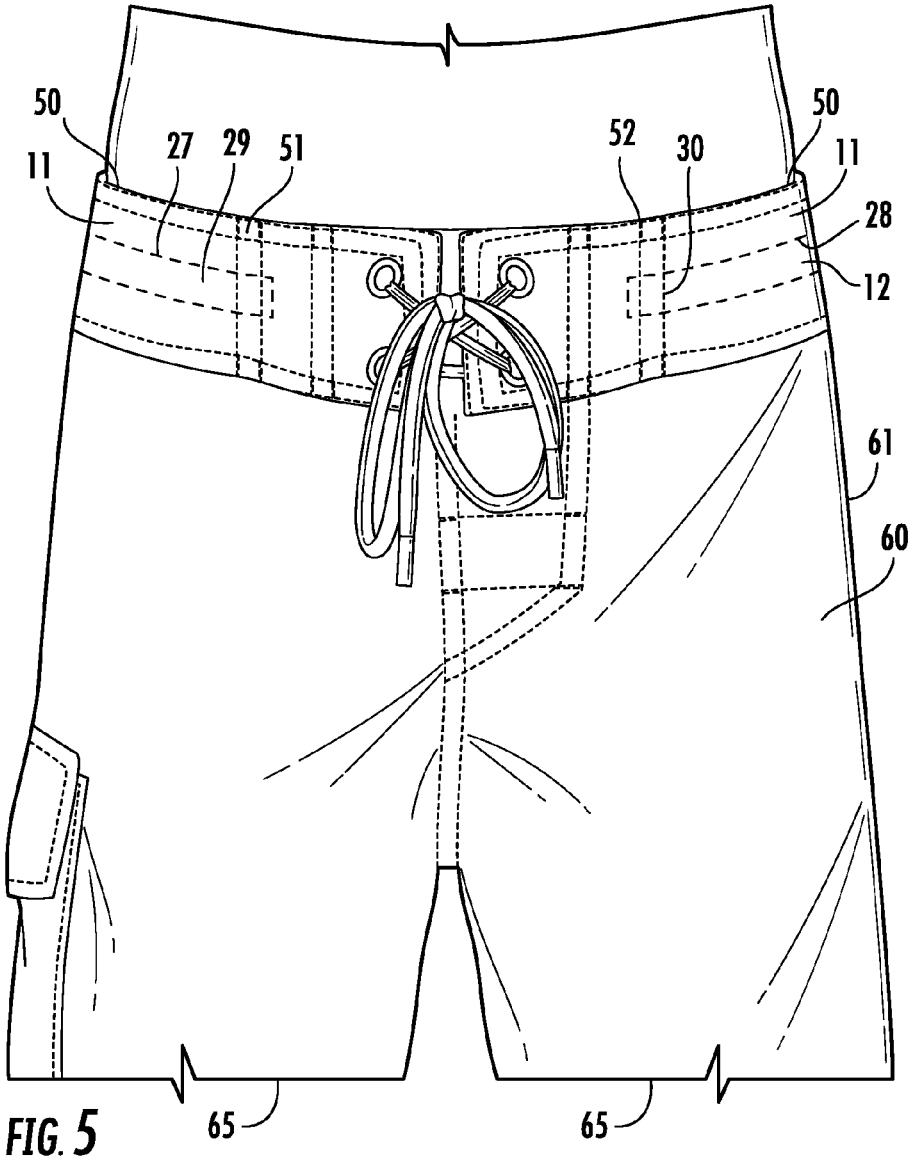
FIG. 5 is a schematic diagram of a front view of the adjustable bathing suit.

In a preferred embodiment, first adjustable band 27 and second adjustable waistband 28 extend from rear center portion 26 around the front of hips 50, as shown in FIG. 5. End 29 and end 30 can be sewn to waistband 12 along respective lines 51 and 52. As shown in FIG. 5, adjustable bathing suit comprises front portion 60 coupled or integral with rear portion 61. Leg openings 65 are formed in front portion 60 and rear portion 61. Waistband 12 extends around front portion 60 and rear portion 61. Adjustable bathing suit 10 can be board shorts.

During use, adjustable bathing suit 10 can be tried on and fly 14 closed. Flap 40 is opened to expose adjustable band 25. For example, flap 40 can be opened by a person other than the wearer. Adjustable band 25 is adjusted to the waist of the wearer and opening 32 of first adjustable band 27 and second adjustable band 28 aligned with button 35 is received over the button 35. Flap 40 is closed over adjustable band 27 and adjustable band 28 by attaching self-gripping material strip 44 to self-gripping material strip 46. Adjustable band 25 and flap 40 lie flat against waistband 12 to provide a streamline and secure fit of adjustable bathing suit 10. Any excess of adjustable band 25 extending beyond flap 40 can be cut off.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. An adjustable bathing suit comprising:

a front portion coupled or integral with a rear portion;

leg openings formed in said front portion and said rear portion;

a waistband at a top portion of said front portion and said rear portion;

an adjustable band associated with said waistband, said adjustable band being adjustable at said rear portion for changing the length of said waistband;

an opening in said waistband at said rear portion in the location of said adjustable band;

a flap attached at an upper portion of the waistband, said flap extending over the opening, the flap is adapted to be opened from the rear of the bathing suit to expose the opening and provide access to the adjustable band and the flap is adapted to be closed to extend over the opening for closing the opening and hiding the adjustable band; and a first self-gripping material strip attached to an underneath surface of said flap below said adjustable band and a second self-gripping material strip attached to said waistband at a position under said flap, said flap is closed by attaching said first self-gripping material strip to said second self-gripping material, wherein said adjustable band and said flap lie flat against said waistband in the closed position.

2. The adjustable bathing suit of claim 1 wherein said waistband includes a channel formed therein and at least a portion of said adjustable band extending into said channel and coupled to said channel.

3. The adjustable bathing suit of claim 1 wherein said adjustable band includes a plurality of openings spaced at predetermined distances along said adjustable band and further comprising a button attached to a center of said waistband above said rear portion, said button being received in one of said openings for adjusting the length of said adjustable band.

4. The adjustable bathing suit of claim 3 wherein said adjustable band includes a first adjustable band attached at a distance to the left of said center of said waistband above said rear portion and a second adjustable band attached at a distance to the right of said center of said waistband above said rear portion, said first and second adjustable bands including said plurality of openings and said first and second adjustable bands being individually adjusted.

5. The adjustable bathing suit of claim 4 further comprising stitching formed around said openings.

6. The adjustable bathing suit of claim 1 wherein said first and second self-gripping material strips are formed of a hook and loop material.

7. The adjustable bathing suit of claim 1 wherein the front portion and the rear portion are formed of a quick-dry fabric.

8. The adjustable bathing suit of claim 7 wherein the fabric is polyester.

9. The adjustable bathing suit of claim 1 wherein a fly is formed in said front portion.

10. The adjustable bathing suit of claim of claim 9 wherein said adjustable bathing suit is board shorts.

* * * * *